United States Patent [19]

Hosoi

[11] Patent Number: 4,780,390

[45] Date of Patent: Oct. 25, 1988

[54] ELECTROSTATOGRAPHIC ENCAPSULATED TONER

[75] Inventor: Noriyuki Hosoi, Fujinomiya, Japan

[73] Assignee: Fuji Photo Film Co., Ltd., Tokyo, Japan

[21] Appl. No.: 946,488

[22] Filed: Dec. 24, 1986

[30] Foreign Application Priority Data

Dec. 24, 1985 [JP] Japan ..... 60-294737
Dec. 24, 1985 [JP] Japan ..... 60-294738

[51] Int. Cl.[4] ..... G03G 9/08
[52] U.S. Cl. ..... 430/138; 428/402.2
[58] Field of Search ..... 430/110, 137, 138; 428/402.2

[56] References Cited

U.S. PATENT DOCUMENTS 4,465,755 8/1984 Kiritani et al. ..... 430/138
4,520,091 5/1985 Kakimi et al. ..... 430/138
4,576,890 3/1986 Hosoi ..... 430/110

*Primary Examiner*—John L. Goodrow
*Attorney, Agent, or Firm*—Jules E. Goldberg

[57] ABSTRACT

An electrostatographic encapsulated toner for pressure fixing process comprising a core material which comprises a colorant and a binder composition, and a shell. The binder composition comprises a polymer and an oily liquid in which said polymer is dissolved or swelled in said oily liquid. The core material contains a silicone which is insoluble in the binder composition and the shell has metal oxide particles therein or on its outer surface.

8 Claims, No Drawings

ELECTROSTATOGRAPHIC ENCAPSULATED TONER

BACKGROUND OF THE INVENTION

1. Field of the Invention

The present invention relates to an electrostatographic encapsulated toner employable for producing a visible image from a latent image in a recording method utilizing an electrostatography.

2. Description of Prior Arts

As the process for fixing a toner image in a recording method such as electrostatography, there have been known three fixing processes, that is, a heat fixing process, a solvent fixing process and a pressure fixing process. Recently, the heat fixing process and the pressure fixing process, both using no solvent, are widely used from the viewpoint of the prevention of environmental pollution.

In the heat fixing process, a toner comprising a colorant bound with a binder has been conventionally employed. The same kind of toner is also employed in the pressure fixing process, but utilization of an encapsulated toner is recently proposed in the pressure fixing process.

The encapsulated toner is a toner in the form of micro-capsule prepared by enclosing a core material comprising a colorant such as carbon black and a binder with a resin shell which is rupturable by the application of pressure.

The conventional encapsulated toner is not necessarily satisfactory in various properties that are essentially required for a toner employable in the electrostatography.

In more detail, a toner employable as a developing agent in electrostatography is required to have various excellent properties such as high powder flowability, high developing efficiency, and no smearing of the surface of a photosensitive medium for producing a latent image. Further, in the case of a two-component developing process, it is necessary that the toner does not smear the surface of the employed carrier. In the pressure fixing process, high fixability, little occurrence of offsetting phenomenon on a pressure roller used in the process (namely, toner adheres to the surface of a pressure roller to stain the roller), etc. are also required for the toner.

Accordingly, the toner employed in the pressure fixing process should be satisfactory in all properties such as powder flowability, fixability to a supporting medium (e.g., paper), preservation stability of the fixed image, anti-offsetting property, and electrostatic chargeability and/or conductivity required depending upon a developing process. However, the conventional toners are not well satisfactory in the above-mentioned characteristics.

For instance, Japanese Patent Provisional Publication No. 54(1979)-76233 describes an encapsulated toner having colloidal silica, aluminum silicate or calcium silicate on the surface of the shell for improving the flowablity of the encapsulated toner. This toner is favorable in improving the flowablity, but no improvement is given with respect to the fixability.

The improvement of the fixability of the encapsulated toner is disclosed in Japanese Patent Provisional Publication No. 60(1985)-184259 in which a specific silicone is incorporated into the toner. The improvement of the fixability is based on the conception that the fixed toner image is arranged to provide a well sliding surface whereby keeping the toner image from dropping off caused by contact with other material. The silicone is introduced into the toner to give improved sliding function.

However, according to study of the present inventor, the incorporated silicone is apt to ooze out of the surface of the shell to produce agglomerates of toner particles. It has been further discovered that the silicone being dissolved in the binder system of the core material as disclosed in the above-mentioned publication does not give well improved sliding function.

SUMMARY OF THE INVENTION

It is an object of the present invention to provide an encapsulated toner employable in electrostatography which is improved in fixability.

It is another object of the invention to provide an encapsulated toner employable in electrostatography which is excellent in powder flowability and free from offsetting.

It is a further object of the invention to provide an encapsulated toner employable in electrostatography which is suitable for giving a toner image having improved resulution.

There is provided by the present invention an electrostatographic encapsulated toner comprising a core material which comprises a colorant and a binder composition comprising a polymer and an oily liquid in which said polymer is dissolved or swelled in said oily liquid and a shell enclosing said core material, wherein said core material contains a silicone being insoluble in the binder composition; and said shell has metal oxide particles therein or on the outer surface thereof.

DETAILED DESCRIPTION OF THE INVENTION

The encapsulated toner of the invention has a basic structure comprising a core material and a shell enclosing the core material. The core material of the encapsulated toner of the invention comprises a binder comprising a polymer and an oily liquid, a colorant and a silicone such as a silicone oil, a silicone rubber or a silicone resin.

There is no specific limitation on the polymer which is a binder component contained in the core material of the encapsulated toner of the invention.

Examples of the polymer include polyolefin, olefin copolymer, styrene resin, styrene-butadiene copolymer, epoxy resin, polyester, rubbers, polyvinylpyrrolidone, polyamide, coumarone-indene copolymer, methyl vinyl ether-maleic anhydride copolymer, amino resin, polyurethane, polyurea, homopolymers or copolymers of acrylic acid ester, homopolymers or copolymers of methacrylic acid ester, acrylic acid-long chain alkyl methacrylate copolymer oligomer, polyvinyl acetate, and polyvinyl chloride. The polymers can be employed singly or in combination.

Among the polymers, preferably employed are homopolymers or copolymers of acrylic acid esters, homopolymers or copolymers of methacrylic acid esters, and styrene-butadiene copolymers.

The oily liquid employable for the binder is a high-boiling solvent capable of dissolving or swelling the above-described polymer but essentially incapable of dissolving or swelling the silicone employed in combination, and having a boiling point of not lower than 150° C. (referred to simply as high-boiling solvent). Examples of the high-boiling solvents include phthalic acid esters such as diethyl phthalate and dibutyl phthalate; aliphatic dicarboxylic acid esters such as diethyl malonate and dimethyl oxalate; phosphoric acid esters such as tricresyl phosphate and trixylyl phosphate; citric acid esters such as O-acetyl triethyl citrate and tributyl citrate; benzoic acid esters such as butyl benzoate and hexyl benzoate; aliphatic acid esters such as hexadecyl myrestate and dioctyl adipate; alkylnaphthalenes such as methylnaphthalene, dimethylnaphthalene, monoisopropylnaphthalene and diisopropylnaphthalene; dialkylphenyl ethers such as di-o-methylphenyl ether, di-m-methylphenyl ether and di-p-methylphenyl ether; amides of higher fatty acids or aromatic sulfonic acids such as N,N-dimethyllauroamide and N-butylbenzenesulfonamide; trimellitic acid esters such as trioctyl trimellitate; and diarylalkanes such as diarylmethanes (e.g., dimethylphenylphenylmethane) and diarylethanes (e.g., 1-phenyl-1-methylphenylethane, 1-dimethylphenyl-1-phenylethane and 1-ethylphenyl-1-phenylethane). The high-boiling solvents can be employed singly or in combination.

Among the high-boiling solvents, alkylnaphthalenes, alkyldiphenyl ethers and diarylalkanes are preferred.

In addition to the oily liquid or oily binder, there can be employed an organic liquid substantially not dissolving or swelling the above-mentioned polymer and having a boiling point of 100°–250° C. (also referred to simply as low-boiling liquid), as well as the high-boiling solvent.

Examples of the low-boiling liquid include saturated aliphatic hydrocarbons and organic liquid mixtures mainly containing saturated aliphatic hydrocarbons.

The ratio of the low-boiling liquid to the high-boiling solvent can be optionally selected, but preferably is in the range of from 9/1 to 1/9 (high-boiling solvent/low-boiling liquid), by weight.

The binder employed in the invention preferably has a composition comprising the above-mentioned polymer and high-boiling solvent. Also preferred is a binder having a composition comprising the above-mentioned polymer, high-boiling solvent and low-boiling liquid.

The ratio of the polymer to the high-boiling solvent is desirably in the range of 0.1 to 100 (polymer/high-boiling solvent), by weight. The ratio of a combination of the polymer and the high-boiling solvent to the low-boiling liquid is also desirably in the range of 0.1 to 100 (combination of polymer and high-boiling solvent/low-boiling liquid), by weight.

The binder composition comprising the oily liquid and polymer preferably has a viscosity in the range of 1,000 to 100,000 cp (25° C.).

As a colorant contained in a conventional toner for the electrostatography, generally employed are a black toner such as carbon black or graft carbon black and a chromatic toner such as a blue, red or a yellow colorant. In the encapsulated toner of the invention, these colorants can be also employed.

The encapsulated toner of the present invention is characterized in that a silicone is contained in its core material in which the silicone is neither dissolved nor swelled in the binder composition and forms a phase essentially independent of the binder composition.

Examples of the silicone include a silicone oil, a silicone rubber and a silicone resin.

As the silicone oil employable in the invention, there can be mentioned a silicone oil having a dimethyl siloxane structure and a silicone oil having a methylphenyl siloxane structure. These silicone oils can be employed singly or in combination.

Examples of the silicone oil having a dimethyl siloxane structure include those commercially available such as Silicone KF-96 (available from Shinetsu Chemical Industry Co., Ltd., Japan), Silicone KF-96H (available from the same) and Silicone SH (available from Toray Silicone Co., Ltd., Japan).

Examples of the silicone oil having a methylphenyl siloxane structure include Silicone KF-50 (available from Shinetsu Chemical Industry Co., Ltd.).

The viscosities of the above-mentioned silicone oils generally are in the wide range. For instance, Silicone KF-96L (trade name of Shinetsu Chemical Industry Co., Ltd.) has a low viscosity of 0.65 cs at 25° C., and Silicone KF-96H (trade name of the same) has a high viscosity of 1,000,000 cs at 25° C.

The silicone oil employable in the invention preferably has a viscosity in the range of 500 to 9,500 cs at Examples of the silicone rubber include dimethylsilicone raw rubber, methylphenylsilicone raw rubber, methylvinylsilicone raw rubber and methylphenylvinylsilicone raw rubber.

Examples of the silicone resin include commercially available silicone resins in powder forms.

Among the silicone materials, the silicone oil is preferred. The silicone oil can be employed in combination with the silicone rubber or the silicone resin.

The silicone is contained in the core material in an amount of preferably 0.5–8% by weight, more preferably 1–4% by weight, based on the whole amount of the encapsulated toner. When the amount of the silicone is smaller than 0.5% by weight, the aimed fixability of the resulting toner is difficulty obtained. No additional effect is expected even if the silicone is added in an amount of exceeding 8% by weight.

The core material of the encapsulated toner of the invention may further contain magnetizable particles. As the magnetizable particles, there can be mentioned magnetizable particles (particulate material capable of being magnetized) employable for a conventional magnetic toner. Examples of the magnetizable particles include particles of a simple metal (e.g., cobalt, iron, or nickel), an alloy and a metallic compound. In the case of using a chromatic magnetizable powder such as a powder of black magnetite, the chromatic magnetizable powder can serve as both of a magnetizable particle and a colorant.

There is no specific limitation on the resin employable for producing a shell of the encapsulated toner. From the viewpoint of various properties required for an encapsulated toner, preferred are polyurethane resin, polyurea resin, polyamide resin and epoxy resin. These resins can be employed singly or in combination.

The encapsulated toner of the invention has metal oxide particles in the shell or on the surface of the shell. The metal oxide particles in or on the shell of are supposed to adsorb silicone oozing from the core portion on the surface, thereby keeping the toner from forming an agglomerated mass and from lowering the powder flowability.

Examples of the metal oxide particles include silica (silicon oxide), magnesia (magnesium oxid), alumina (aluminum oxide), and titanium dioxide. The metal oxide preferably is not magnetizable.

Particularly preferred is a hydrophobic silica. The hydrophobic silica preferably has a mean particle size (as primary particle) in the range of 5–17 mμ. Examples of the hydrophobic silica include dimethyldichlorosilane-treated silica, hexamethyldisilazane-treated silica, octyltrimethoxysilane-treated silica, and silicone oil-treated silica.

The metal oxide particles are provided to the encapsulated toner in an amount of 0.1–5% by weight, preferably in an amount of 0.5–3% by weight, per the whole amount of the toner. The metal oxide particles are preferably partly or wholly embedded in the shell so that the particles are stably retained on the shell.

The process for the preparation of the encapsulated toner of the invention will be described below in more detail by referring to a process for the preparation of an encapsulated toner comprising a shell of polyurethane resin, polyurea resin or polyamide resin.

In the preparation of an encapsulated toner, there can be utilized a conventional process comprising the steps of producing micro-capsules by forming a shell around a core material in an aqueous liquid through an interfacial polymerization or an outer polymerization, particularly producing micro-capsules based on the polymerization reaction, and washing the micro-capsules with water.

As a shell-forming method for producing micro-capsules having a shell of polyurethane resin or polyurea resin, an interfacial polymerization is employed.

A shell of polyurea resin and/or polyurethane resin is easily prepared as a shell of micro-capsules by subjecting polyisocyanate (e.g., diisocyanate, triisocyanate, tetraisocyanate and polyisocyanate prepolymer) to the interfacial polymerization reaction with polyamine (e.g., diamine, triamine and tetraamine), prepolymer having two or more amine groups, piperazine and derivatives thereof, or polyol in an aqueous solvent.

A shell composed of a complex layer comprising a polyurethane resin and/or a polyurea resin and a polyamide resin (e.g., a complex layer comprising a polyurethane resin and a polyamide resin, a complex layer comprising a polyurea resin and a polyamide resin, or a complex layer comprising a polyurethane resin, a polyurea resin and a polyamide resin) can be prepared by the following process.

In the case of a shell composed of a complex layer comprising a polyurethane resin and a polyamide resin, the shell can be prepared by the interfacial polymerization comprising the steps of adjusting pH of an emulsion medium for forming a reaction liquid and heating the reaction liquid, using a combination of polyisocyanate and acid chloride, polyamine and polyol. In the case of a shell composed of a complex layer comprising a polyurea resin and a polyamide resin, the shell can be prepared by the interfacial polymerization comprising the steps of adjusting pH of an emulsion medium for forming a reaction liquid and heating the reaction liquid, using a combination of polyisocyanate and acid chloride, and polyamine. Processes for preparing the above-mentioned shell of a complex layer comprising a polyurethane resin and a polyamide resin or a complex layer comprising a polyurea resin and a polyamide resin are described in detail in Japanese Patent Provisional Publication No. 58 (1983)-66948. The shell composed of such complex layer is particularly suitable for producing an encapsulated toner containing magnetizable particles in its core material. A monomer contributing to the polymerization reaction for forming a resin shell varies depending upon the shell-forming resin, a combination of two or more monomers are generally employed. An example of the combination is a combination of at least one bifunctional group compound selected from the group consisting of isocyanate group, bischloroformate group, acid chloride group and sulfonyl-chloride group and at least one compound selected from the group consisting of water, polyvalent amine, polyhydric alcohol and polycarboxylic acid.

In the preparation of the encapsulated toner of the invention, micro-capsules can be produced by dispersing the core material comprising the aforementioned colorant, binder composition and silicone (and magnetizable particles, if desired) and one compound of shell-forming material in the form of droplet in an aqueous medium (containing other compound of shell-forming material), and then forming a shell of polyurethane or polyurea resin around the core material. Processes for the preparation of micro-capsules by forming a shell around the core material in the form of droplet are already known as described hereinbefore, and these known processes can be utilized in the invention.

The micro-capsules prepared as above by forming the shell around the core material are separated from the liquid, and the separated micro-capsules are dried. The separating and drying the micro-capsules can be done by subjecting the obtained dispersion (or slurry) containing micro-capsules to a spray drying or a heat drying.

The metal oxide particles can be incorporated into the shell of the toner, for instance, by admixing the metal oxide particles with a slurry of the microcapsule and then drying together by a conventional heating method. Otherwise, the metal oxide particles can be admixed with a dried microcapsule to be provided to the surace of the shell of the toner.

There is no specific limitation on the apparatus or device employable for the admixing and the drying. Admixing can be done using a conventional mixer or V-shape blender. Examples of the devices include an electric furnace, a muffle furnace, a hot plate, an electric dryer, a fluid-bed dryer and an infrared rays dryer.

The shell of the encapsulated toner of the invention may further contain other optional additives such as an electrostatic charge modifier (e.g., a dye containing metal and nigrosine) and solid particles (e.g., hydrophobic silica), if desired. Those additives can be incorporated into the shell in an optical stage of the process such as a shell-forming stage or other stage after the separation and drying procedure.

The examples and the comparison example of the present invention are given below.

EXAMPLE 1

40 g. of 1-isopropyl-phenyl-2-phenylethane solution containing 50 wt.% of polyisobutyl methacrylate (trade name: Acrybase, MM-2002-2; available from Fujikura Kasei Co., Ltd.) was mixed with 40 g. of magnetite particles in an automatic mortar, to prepare a dispersion (magnetizable ink).

Separately, in 20 g. of ethyl acetate was dissolved 9.9 g. of an addition product of 3 moles of xylylene diisocyanate and 1 mole of trimethylolpropane (Takeneate D-110N, tradename, available from Takeda Chemical Industries, Ltd.). This solution was added to the above-obtained dispersion (magnetizable ink), and to this was further added 3 g. of silicone oil having a dimethylsiloxane structure (trade name: Silicone KF-96, 1,000 cs at 25° C., available from Shinetsu Chemical Industry Co., Ltd.), to prepare an oily dispersion. The oil dispersion (mixture of core material and shell-forming material) was prepared by setting the temperature of the liquid to not higher than 25° C.

Independently, to 200 g. of a 4 wt.% solution of methylcellulose (methoxy group substitution degree: 1.8%, mean molecular weight: 15,000) was added 0.2 g. of diethylenetriamine, to prepare an aqueous solution. The aqueous solution was cooled to 15° C.

In the aqueous solution was dispersed the above-prepared oily dispersion to produce an oil-in-water emulsion containing droplets having average diameter of approx. 12 μm.

In approx. 10 minutes after the preparation of the emulsion, 50 g. of a 2.5 wt.% solution of diethylenetriamine was dropped little by little in the emulsion, and the emulsion was stirred for 3 hours in a bath kept at 60° C. to complete the encapsulation. Thus obtained micro-capsule dispersion was subjected to centrifugal separation at 5,000 rpm so as to separate the micro-capsules from the aqueous solution containing methylcellulose (supernatant liquid). The obtained micro-capsule slurry was dispersed in water to prepare a 30 wt.% dispersion. The dispersion was again subjected to the centrifugal separation to produce a micro-capsule slurry, and the micro-capsule slurry was dispersed in water to prepare a 30 wt.% dispersion. The dispersion was then subjected once more to washing procedure comprising centrifugal separation and dispersing in water, to prepare a micro-capsule slurry. To the obtained micro-capsule slurry was added 20 g. of 5 wt.% colloidal silica dispersion (which had been prepared by vigorously mixing 5 g. of hydrophobic colloidal silica (tradename R-974, mean diameter: 12 mμ, available from Nippon Aerogil Co., Ltd., Japan) in 95 g. of water). The resulting mixture was well stirred and then dried in an oven to obtain a powdery encapsulated toner.

It was confirmed that the obtained encapsulated toner particles were independent from each other and showed high flowability.

The obtained toner was stored in a sealed polyethylene resin vessel for 6 months, and the flowability was examined. There was observed no substantial change in the flowability, and no agglomerated mass of the toner particles was observed.

The encapsulated toner obtained above was evaluated on the pressure fixability in the following manner.

Using the encapsulated toner, a latent image produced by a conventional electrostatography was developed to form a toner image, and the toner image was transferred onto a transfer paper to obtain a visible image on the paper. The visible image was then fixed onto the paper by using a pressure fixing roller at a pressure of 200 kg/cm$^2$.

The obtained duplicate image was well fixed and had high sharpness. Further, the toner hardly adhered to the roller. In addition, even when the duplicate image fixed onto the transfer paper was rubbed with a finger, no toner separated from the paper, and no adverse effect was given to the duplicate image.

The fixability, flowability, resistance to offsetting (anti-offsetting) and the stability after storage of a long period of time (6 months) were examined. The results are set forth in Table 1.

EXAMPLE 2

40 g. of 1-isopropyl-phenyl-2-phenylethane solution containing 50 wt.% of polyisobutyl methacrylate (trade name: Acrybase, MM-2002-2; available from Fujikura Kasei Co., Ltd.) was admixed with 40 g. of magnetite particles and 20 g. of the 5% colloidal silica dispersion (same as prepared in Example 1) in an automatic mortar, to prepare a dispersion (magnetizable ink).

Thereafter, the obtained dispersion was treated in the manner as in Example 1 except that silicone oil having a dimethylsiloxane structure (trade name: Silicone KF96, 300 cs at 25° C., available from Shinetsu Chemical Industry Co., Ltd.) was employed as the silicone oil, to prepare an encapsulated toner.

The fixability, flowability, resistance to offsetting (anti-offsetting) and the stability after storage of a long period of time (6 months) were examined. The results are set forth in Table 1.

EXAMPLE 3

The procedure of Example 1 was repeated except that the colloidal silica was replaced with the same amount of other hydrophobic colloidal silica (tradename R-976, mean diameter: 16 mμ, available from Nippon Aerogil Co., Ltd., Japan), to prepare an encapsulated toner.

The fixability, flowability, resistance to offsetting (anti-offsetting) and the stability after storage of a long period of time (6 months) were examined. The results are set forth in Table 1.

EXAMPLE 4

The procedure of Example 1 was repeated except that 1-isopropyl-phenyl-2-phenylethane was replaced with the same amount of a combination of diisopropylnaphthalene and paraffin oil having 10–12 carbon atoms (3:2, by weight), to prepare an encapsulated toner.

The fixability, flowability, resistance to offsetting (anti-offsetting) and the stability after storage of a long period of time (6 months) were examined. The results are set forth in Table 1.

COMPARISON EXAMPLE 1

The procedure of Example 1 was repeated except for using no silicone oil to prepare an encapsulated toner.

The fixability, flowability, resistance to offsetting (anti-offsetting) and the stability after storage of a long period of time (6 months) were examined. The results are set forth in Table 1.

COMPARISON EXAMPLE 2

The procedure of Example 1 was repeated except for using no colloidal silica to prepare an encapsulated toner.

The fixability, flowability, resistance to offsetting (anti-offsetting) and the stability after storage of a long period of time (6 months) were examined. The results are set forth in Table 1.

COMPARISON EXAMPLE 3

The procedure of Example 1 was repeated except for using isopropyl laurate in place of 1-isopropyl-phenyl-2-phenylethane to prepare an encapsulated toner.

The fixability, flowability, resistance to offsetting (anti-offsetting) and the stability after storage of a long period of time (6 months) were examined. The results are set forth in Table 1.

TABLE 1

| | Fixability | Flowability | Anti-offsetting | Storage |
|---|---|---|---|---|
| Example | | | | |
| 1 | B | A | A | A |
| 2 | B | A | A | A |
| 3 | A | B | A | A |
| 4 | A | A | A | A |
| Comparison Example | | | | |
| 1 | D | A | C | A |
| 2 | A | C | B | D |
| 3 | D | A | C | A |

In Table 1, the ranks indicate the following:

A: very satisfactory

B: satisfactory (practically acceptable)

C: poor

D: extremely poor.

I claim:

1. An electrostatographic encapsulated toner comprising a core material which comprises a colorant and a binder composition comprising a polymer and an oily liquid in which said polymer is dissolved or swelled in the oily liquid and a shell enclosing said core material, wherein said core material contains a silicone oil in an amount ranging from 0.5 to 8% by weight based on the whole amount of the encapsulated toner, said silicone oil being insoluble in the binder composition, and said shell has metal oxide particles therein or on the outer surface thereof.

2. The electrostatographic encapsulated toner as claimed in claim 1, wherein said silicone oil has a viscosity in the range of 500–9,500 cp at 25° C.

3. The electrostatographic encapsulated toner as claimed in claim 1, wherein said silicone oil has a viscosity in a range of 500–6,000 cp at 25° C.

4. The electrostatographic encapsulated toner as claimed in claim 1, wherein said silicone oil has a dimethylsiloxane structure.

5. The electrostatographic encapsulated toner as claimed in claim 1, wherein said silicone oil has a methylphenylsiloxane structure.

6. The electrostatographic encapsulated toner as claimed in claim 1, wherein said metal oxide particles are contained in an amount ranging from 0.1 to 5% by weight based on the whole amount of the encapsulated toner.

7. The electrostatographic encapsulated toner as claimed in claim 1, wherein said metal oxide particles are hydrophobic silica particles having a mean particle size in the range of 5–17 mμ.

8. The electrostatographic encapsulated toner as claimed in claim 1, wherein said oily liquid is selected from the group consisting of alkylnaphthalenes, alkyldiphenyl ethers and diarylalkanes.

* * * * *